US008882517B2

(12) United States Patent
Smith et al.

(10) Patent No.: US 8,882,517 B2
(45) **Date of Patent: *Nov. 11, 2014**

(54) SPLIT ELECTRICAL GROUNDING BUSHING WITH SECURELY ATTACHED SECTIONS FORMING CONTINUOUS INSULATION

(71) Applicant: Bridgeport Fittings, Inc., Stratford, CT (US)

(72) Inventors: Lawrence J. Smith, Stamford, CT (US); Joseph M. Thomas, North Haven, CT (US)

(73) Assignee: Bridgeport Fitting, Inc., Stratford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/750,683

(22) Filed: Jan. 25, 2013

(65) Prior Publication Data

US 2013/0133943 A1 May 30, 2013

Related U.S. Application Data

(63) Continuation-in-part of application No. 13/267,099, filed on Oct. 6, 2011, now Pat. No. 8,419,449.

(51) Int. Cl.
*H01R 13/648* (2006.01)
*H01R 4/64* (2006.01)
*H01R 4/36* (2006.01)

(52) U.S. Cl.
CPC .. *H01R 4/64* (2013.01); *H01R 4/36* (2013.01); *H01R 4/643* (2013.01)
USPC ..... 439/92

(58) Field of Classification Search
CPC ..... H01R 4/64
USPC ..... 439/92, 98–100, 83, 367
See application file for complete search history.

(56) References Cited

U.S. PATENT DOCUMENTS

| | | | | |
|---|---|---|---|---|
| 3,711,632 | A * | 1/1973 | Ghirardi | 174/135 |
| 5,305,978 | A | 4/1994 | Current | 248/230 |
| 6,840,782 | B1 | 1/2005 | Borden et al. | 439/92 |
| 7,178,203 | B2 | 2/2007 | Pearson et al. | 24/16 |
| 7,182,611 | B2 | 2/2007 | Borden et al. | 439/92 |
| 7,850,485 | B2 * | 12/2010 | Bartholoma et al. | 439/550 |
| 8,231,392 | B2 | 7/2012 | Garvin | 439/100 |
| 8,419,449 | B1 * | 4/2013 | Smith | 439/92 |
| 8,512,052 | B2 * | 8/2013 | Garvin | 439/100 |
| D695,100 | S * | 12/2013 | Whitaker et al. | D8/396 |

* cited by examiner

*Primary Examiner* — Phuongchi T Nguyen
(74) *Attorney, Agent, or Firm* — Fattibene and Fattibene LLC; Paul A. Fattibene

(57) ABSTRACT

A split electrical grounding bushing having adjacent bushing portions with insulating bushing portions having guard tabs covering a gap formed between the insulating bushing portions creating a continuous insulating ring. The bushing portions are connected by a hinge permitting the bushing to be placed over electrical conductors or wires after being installed. Gaps in the insulating bushing portion are covered by attached guard tabs improving the safety of a split electrical bushing. Locking tabs and openings are used to securely hold the insulating bushing portions onto the bushing portions. The split electrical bushing is placed on a distal end of an electrical conduit. The split bushing may be an electrical grounding bushing providing an electrical ground connection.

17 Claims, 9 Drawing Sheets

SPLIT ELECTRICAL GROUNDING BUSHING WITH SECURELY ATTACHED SECTIONS FORMING CONTINUOUS INSULATION

RELATED APPLICATION

This application is a continuation-in-part of application Ser. No. 13/267,099 filed Oct. 6, 2011.

FIELD OF THE INVENTION

The present invention relates in general to a bushing attached to the end of an electrical conduit, and more particularly to a split ring electrical grounding bushing having securely attached continuous insulation providing improved safety.

BACKGROUND OF THE INVENTION

Bushings are typically installed at the end of electrical conduits to prevent the wires or conductors placed therein from becoming damaged or contacting the electrical conduit or a junction box. Often grounding bushings are used so that an electrical conduit may also be grounded or provided with a path to ground. Sometimes electrical connections are made and the attachment of electrical conductors or wires have been completed when it is discovered that the ring-shaped bushing was not installed on the terminal end of an electrical conduit for protection of the electrical conductors or wires contained therein. In order to prevent the laborious task of disconnecting the electrical conductors or wires and feeding a closed ring-shaped bushing along the wires to be placed on the terminal end of the electrical conduit, split or sectioned bushings have been used.

One such split or sectioned grounding bushing that is hinged is disclosed in U.S. Pat. No. 6,840,782 entitled "Dual Sectioned Grounding Bushing Assembly" issuing on Jan. 11, 2005 to Borden et al, which is herein incorporated by reference. Therein disclosed is a grounding bushing assembly that has two bushing sections that are hinged or pivoted. A latch structure secures the ends opposing the hinged end, thereby forming a ring. The dual sectioned grounding bushing permits an electrician to install the bushing either before or after electrical connections are finalized. While this dual sectioned grounding bushing has proven to be convenient for attaching a bushing to an electrical conduit once the electrical conductors or wires have been attached, problems have arisen in that the sectioned insulation forms a gap adjacent the hinged end and the opposing latched end. Therefore, with this gap in insulation there is the possibility that the electrical conductors or wires might be damaged, forming a hazardous condition. Therefore, there is a need for an improved sectioned or split grounding bushing that can be installed on electrical conduits after the electrical conductors or wires have been attached, and yet provide a continuous electrical insulation so as to prevent the risk of damage to the electrical conductors or wires and thereby eliminate electrical shocks or shorts.

SUMMARY OF THE INVENTION

The present invention comprises a split bushing that has bushing portions that may be separated for placement around an electrical conduit and provide a continuous ring of electrical insulation. A first bushing portion and a second bushing portion are attached together forming a ring. A first and second insulating bushing portion corresponds with and attaches to the respective first and second bushing portions. At the adjoining first and second bushing portions and first and second insulating bushing portions a gap is formed. A first and second guard tab attached to a respective one of the first and second insulating bushing portions extends over the gap. The first and second guard tabs effectively form a continuous ring of electrical insulation. Therefore, a ring of electrical insulation is continuous over the entire interior circumference of the split bushing. A contact screw may be attached to a bushing portion and extend there through contacting the electrical conduit. A lug may also be attached to one of the bushing portions for attachment of a ground conductor.

The insulating bushing portions are securely attached to the bushing portions by a plurality of locking tabs and openings. The insulating bushing portions can be slid into position over the bushing portions riding on a stove surface of the end locking tabs.

Accordingly, it is an object of the present invention to provide a split grounding bushing that is safer.

It is another object of the present invention to prevent damage to conductors or wires placed within an electrical conduit.

It is an advantage of the present invention that it is easily manufactured and assembled.

It is another advantage of the present invention that it prevents the possibility of an electrical conductor or wire becoming damaged or creating a hazard by contact with a gap formed between the adjoining bushing portions.

It is a feature of the present invention that an effective continuous ring of electrical installation is formed.

It is another feature of the present invention that a guard tab covers a gap formed by the adjacent bushing portions.

It is an object of the present invention to provide insulating bushing portions that are easily and securely attached to the bushing portions.

It is an advantage of the present invention that the insulating bushing portions are easily slid into position and locked in place.

It is a feature of the present invention that the end locking tabs have a sloped or inclined surface that permits the insulating bushing portions to be easily slid into position.

It is another feature of the present invention that central locking tabs additionally secure the insulating bushing portions onto the bushing portions.

These and other objects, advantages, and features will become more readily apparent in view of the following more detailed description.

DETAILED DESCRIPTION OF THE PREFERRED EMBODIMENT

Figure 1:
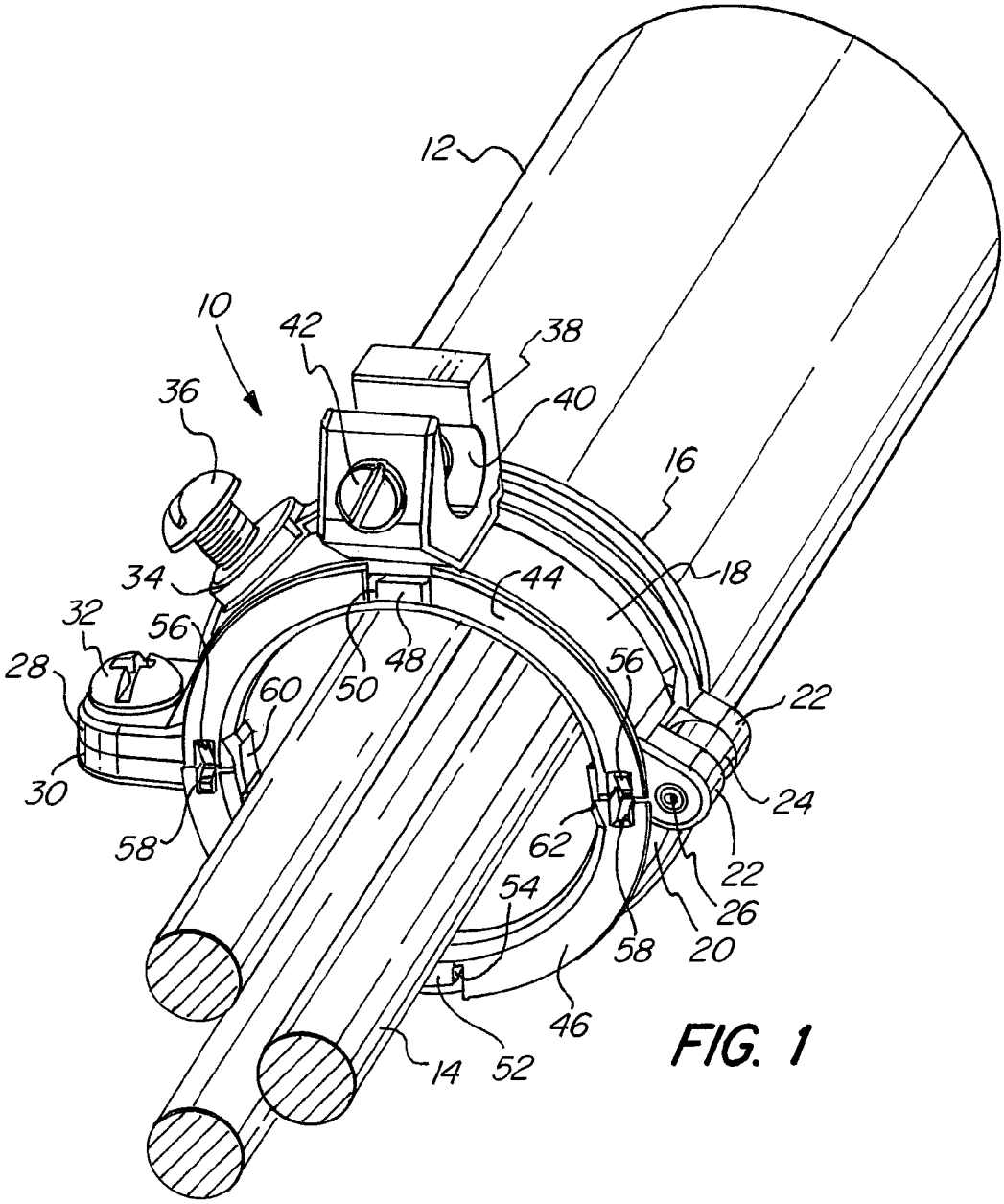
FIG. 1 is a perspective view illustrating a split electrical grounding bushing placed on an electrical conduit.

FIG. 1 is a perspective view illustrating the split electrical grounding bushing 10 of the present invention. The split electrical grounding bushing 10 is illustrated placed on an electrical conduit 12 that contains electrical conductors or wires 14. The electrical conduit 12 has threads 16 thereon. A first bushing portion 18 and a second bushing portion 20 are connected at one end by a hinge formed from outer hinge portions 22 and an inner hinge portion 24 secured together by a hinge pin 26. The first and second bushing portions 18 and 20 each have a generally semi-circular shape. The side opposing the hinged side of the split electrical grounding bushing 10 is secured by a securing screw 32 securing together a first ear 28 attached to the first bushing portion 18 and a second ear 30 attached to the second bushing portion 20. Accordingly, the hinge permits the first bushing portion 18 and the second bushing portion 20 to be pivoted and opened so that the split electrical grounding bushing 10 can be placed on the end of the electrical conduit 12 without disconnecting or detaching the electrical conductors or wires 14. A pad 34 may be formed on the first bushing portion 18. The pad 34 has a threaded bore therein for receiving a contact screw 36. The contact screw 36 extends through the threaded bore in the first bushing portion 18 permitting the contact screw 36 to contact the electrical conduit 12 insuring good electrical contact. Also formed on the first bushing portion 18 is a lug 38. The lug 38 has an opening 40 therein for receiving a grounding conductor, not illustrated. The grounding conductor may be secured to the lug 38 by retaining screw 42.

Attached to the first bushing portion 18 is a first insulating bushing portion 44. The first insulating bushing portion 44 is attached to the first bushing portion 18 by first central locking tab 48 placed within a first locking tab opening 50 and first end locking tabs 56 on either end of the first insulating bushing portion 44. The first end locking tabs 56 may be snapped into openings formed at the ends of the first bushing portion 18. The locking tabs 48 and 56 securely hold the first insulating bushing portion 44 onto the first bushing portion 18. Similarly, on the second bushing portion 20 is placed a second insulating bushing portion 46 that is attached thereto by a second central locking tab 52 placed within a second locking tab opening 54 and second end locking tabs 58.

Formed on the first insulating bushing portion 44 at one end thereof, is a first guard tab 60 that extends over a gap and a portion of the second insulating bushing portion 46. Similarly, a second guard tab 62 is attached to the second insulating bushing portion 46 and extends over a gap and a portion of the first insulating bushing portion 44. Accordingly, gaps formed between the first and second adjacent bushing portions 18 and 20 and the first and second insulating bushing portions 44 and 46 are covered thereby forming a continuous electrical insulating ring around the inner circumference of the split electrical grounding bushing 10 and the electrical conductors or wires 14.

Figure 2:
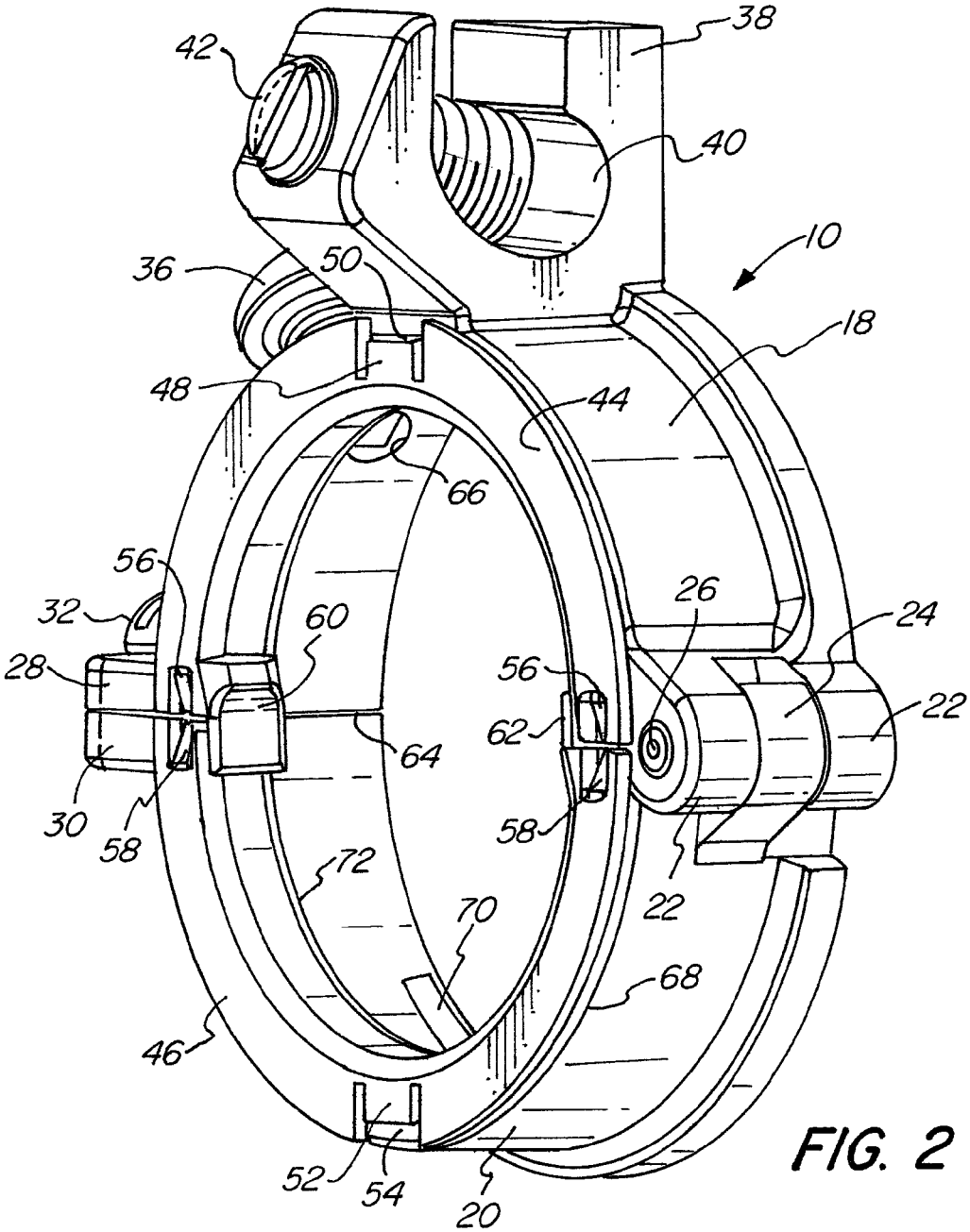
FIG. 2 is a perspective view illustrating the split electrical grounding bushing of the present invention.

FIG. 2 is a perspective view that more clearly illustrates the features and structure of the split electrical grounding bushing 10 of the present invention. In FIG. 2, the gap 64 between the first bushing portion 18 and second bushing portion 20 is more clearly illustrated. Also more clearly illustrated in FIG. 2 is the threaded bore 66 for receiving the contact screw 36. Also, a ridge 70 formed on the second bushing portion 20 is illustrated that mates with the threads 16 on the electrical conduit 12, illustrated in FIG. 1. The ridge 70 in combination with the contact screw 36 securely holds the split electrical grounding bushing 10 onto the electrical conduit 12, illustrated in FIG. 1.

The first and the second insulating bushing portions 44 and 46 are attached to a flange 68 formed on the first and second bushing portions 18 and 20. The first and second insulating bushing portions 44 and 46 may extend axially into the split electrical grounding bushing 10 to an edge 72. The edge 72 is intermediate the axial length of the split electrical grounding bushing 10. Accordingly, the first and second insulating bushing portions 44 and 46 have a radial flange portion and an axial length extending to edge 72.

First guard tab 60 covers the gap 64 over the axial length of the first and second insulating bushing portions 44 and 46 and also extends circumferentially over a portion of the second insulating bushing portion 46. This prevents the electrical conductors or wires 14, illustrated in FIG. 1, from becoming damaged by or contacting the gap 64 preventing a possible electrical hazard or danger. Therefore, a continuous ring of insulation is formed so as to eliminate any discontinuities or gaps within the full circumference of the first and second insulating bushing portions 44 and 46. This greatly improves the safety of a split electrical grounding bushing. The first and second insulating bushings 44 and 46 may be made of any electrical insulator material, and is preferably made of plastic. The first and second bushing portions may be made of any material, and is preferably made of metal, such as steel or die cast zinc or zinc alloy.

Figure 3:
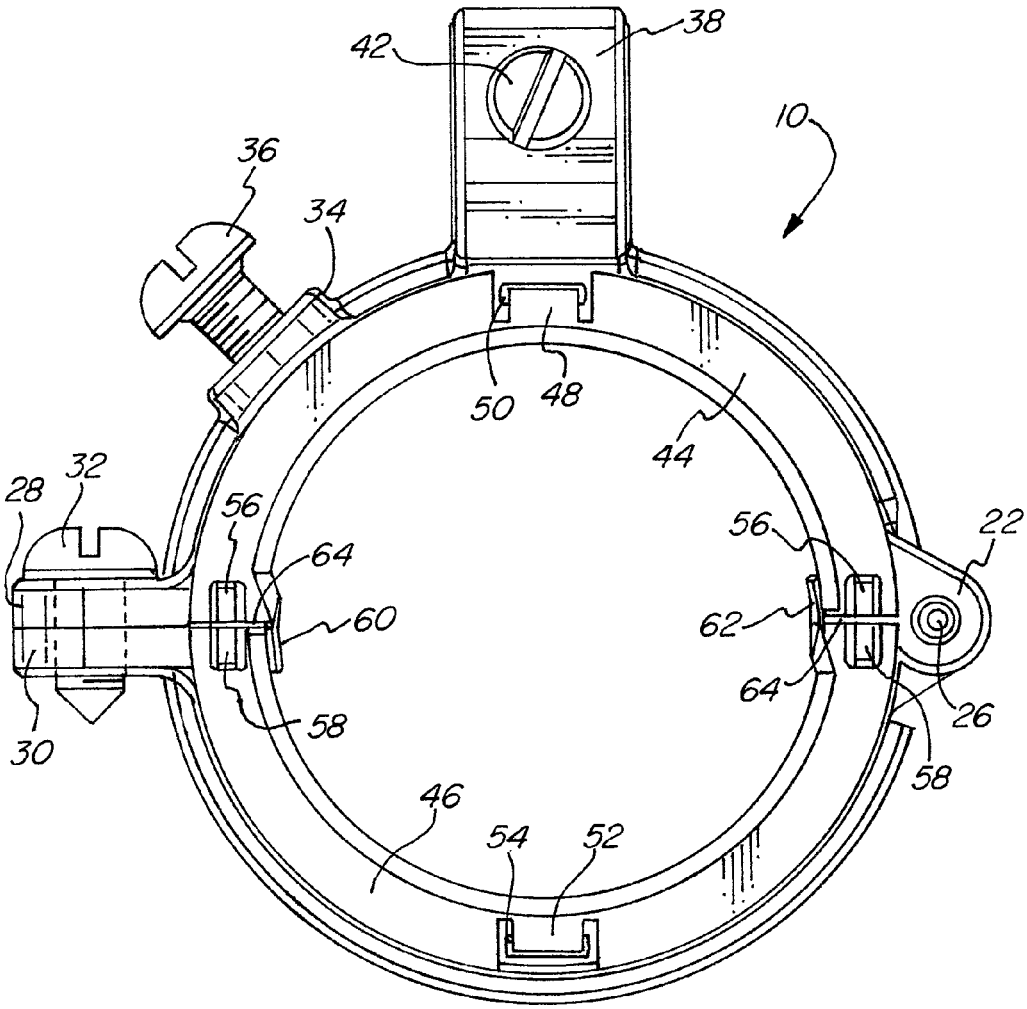
FIG. 3 is a front elevational view of the split electrical grounding bushing of the present invention.

FIG. 3 is a front elevational view more clearly illustrating the opposing gaps 64 formed where each end of the first and second insulating bushing portions 44 and 46 meet. The first and second guard tabs 60 and 62 can clearly be seen covering the gap 64 so as to form a continuous insulation ring, preventing the possibility of the electrical conductors or wires 14, illustrated in FIG. 1, from contacting the gap 64 adjacent the first and second insulating bushing portions 44 and 46. While the guard tabs 60 and 62 are illustrated along the exterior surface adjacent the gaps 64, the guard tabs may be recessed within the first and second insulating bushing portions 44 and 46. Other configurations or shapes of guard tabs are possible as long as the gaps 64 are covered prevented a continuous direct path between the conductors or wires 14, illustrated in FIG. 1, and the grounding bushing 10 or electrical conduit 12.

Figure 4:
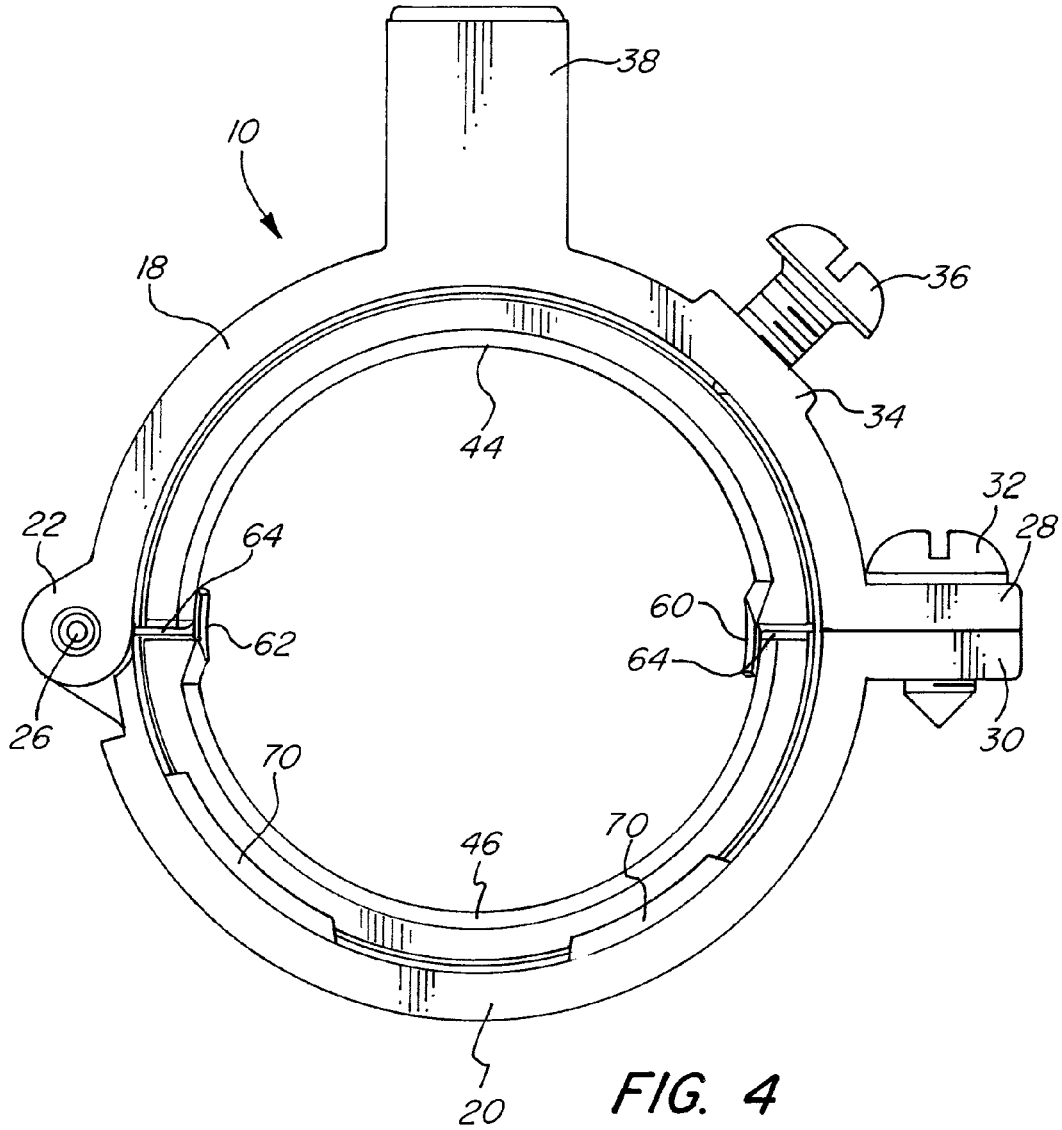
FIG. 4 is a rear elevational view of the split electrical grounding bushing of the present invention.

FIG. 4 is a rear elevational view more clearly illustrating the ridges 70 that mate with the threads 16 on the electrical conduit 12, illustrated in FIG. 1. The ridges 70 are adapted to fit within the threads 16 of the electrical conduit 12, illustrated in FIG. 1. The ridges 70 help to hold the split electrical grounding bushing 10 onto the electrical conduit 12.

Figure 5:
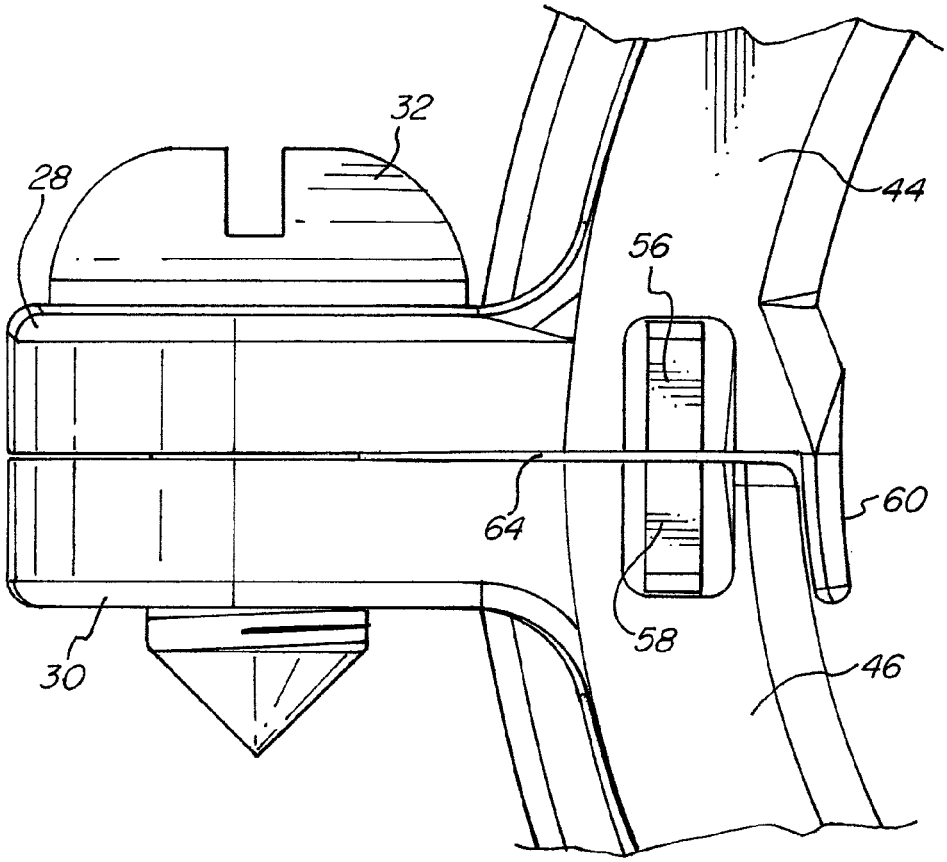
FIG. 5 is an enlarged partial view of a portion of the split electrical grounding bushing illustrated in FIG. 3 and more clearly illustrating a gap and guard tab.

FIG. 5 is an enlarged partial front elevational view illustrating a section of FIG. 3. This enlarged view more clearly illustrates the gap 64 and the covering of the gap 64 by the first guard tab 60.

Figure 6:
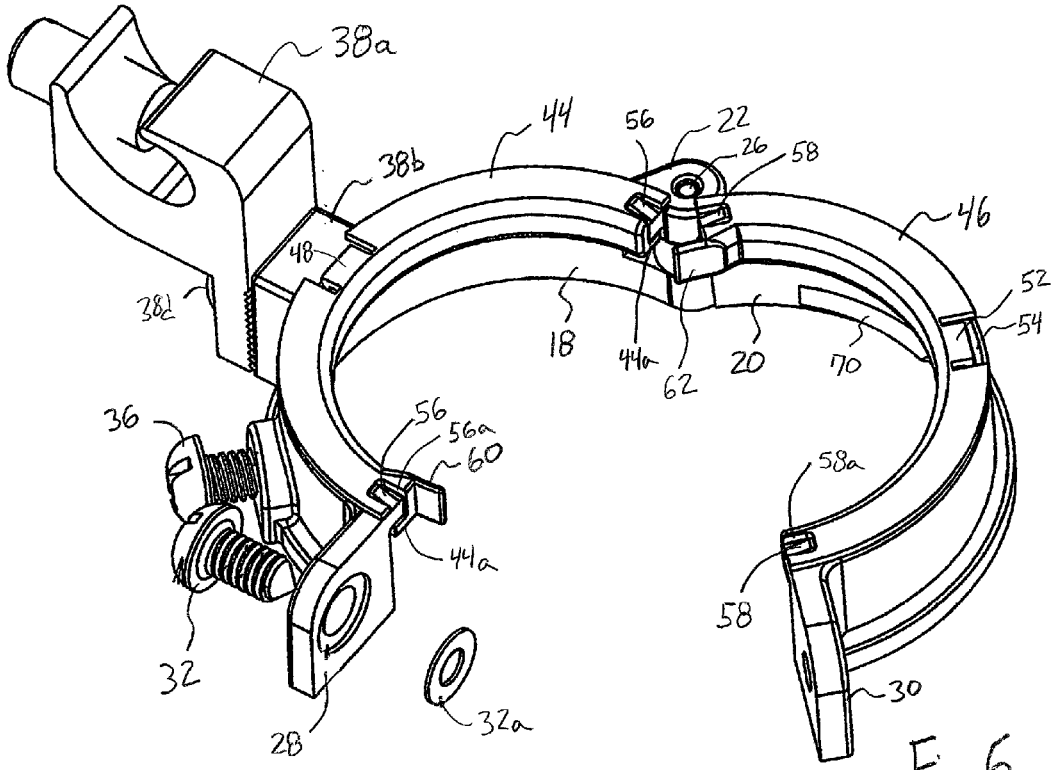
FIG. 6 is a perspective view of the present invention having a detachable lug.

FIGS. 6-16 better illustrating the secure attachment of the insulating bushing portions 44 and 46 to the bushing portions 18 and 20. FIG. 6 illustrates a split electrical grounding bushing having a slightly different lug attachment. Lug 38*a* is attached to a lug mount 38*b* by screw 38*d* through lug mount threaded bore 38*c*.

Figure 7:
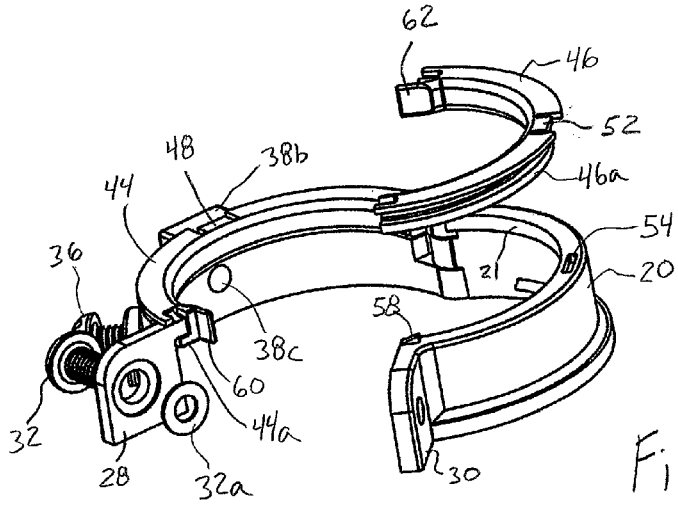
FIG. 7 is a perspective view illustrating the insulated bushing portion attached to the bushing.

FIGS. 6 and 7 illustrate the split electrical grounding bushing open with the bushing portions 18 and 20 separated. The split electrical grounding bushing is securely closed with screw 32 passing through ear 28, washer 32*a*, and threaded into opposing ear 30. FIGS. 6 and 7 more clearly illustrate the locking tabs and the lip 46*a* that wraps around the rim 21 on the second bushing portion 20. The first insulating bushing portion 44 also has a lip 44*a* that wraps around a similar rim on the first bushing portion 18. The second central locking tab 52 on the second insulating bushing portion 46 has a sloping end 53, illustrated in FIG. 13, which fits within the second locking tab opening 54. The locking tabs 56 and 58 have inclined or sloping surfaces and when in position are placed within the locking tab openings 56*a* and 58*a*. When the insulating bushing portions 44 and 46 are slid onto their respective bushing portions 18 and 20 the inclined, sloped, or ramped surface of the end locking tabs 56 and 58 ride on an undersurface of the insulating bushing portions 44 and 46 until the locking tab openings 56*a* and 58*a* are reached and ends of the insulating bushing portions 44 and 46 drop into position and securely lock adjacent the perpendicular surface at the end of the inclined locking tabs 56 and 58. This secure locking into position assures that the guard tabs 60 and 62 are securely held in position forming a continuous insulating barrier ring with no gaps. This configuration of end locking tabs 56 and 58 in combination with the central locking tabs 48 and 52 assure that the insulating bushing portions 44 and 46 are securely held in position and are not forced out of position when conductors or wires 14, as illustrated in FIG. 1, are moved through the conduit 12.

Figure 8:
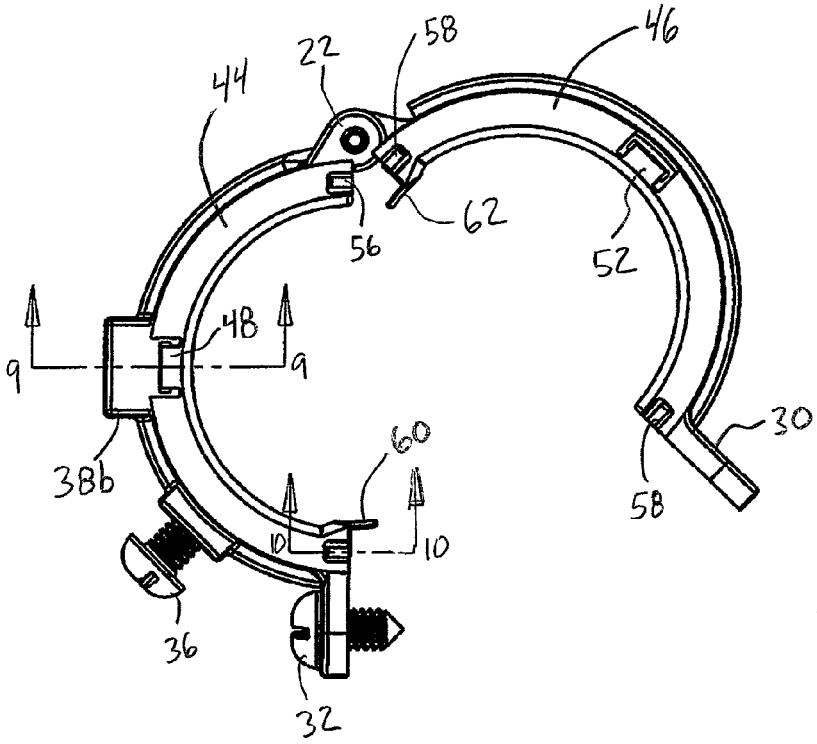
FIG. 8 is a plan view of the split electrical grounding bushing with the lug detached.
Figure 9:
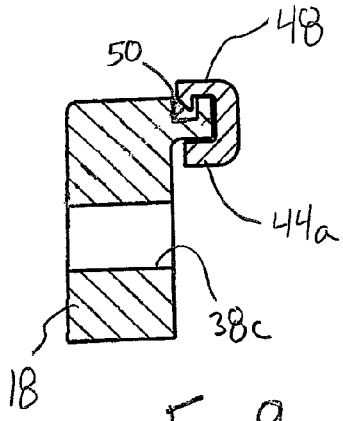
FIG. 9 is a cross section taken along line 9-9 in FIG. 8.

FIG. 9 is a cross section taken along lines 9-9 in FIG. 8. FIG. 9 more clearly illustrates how the first central locking tab 48 fits within the first locking tab opening 50 formed in the first bushing portion 18.

Figure 10:
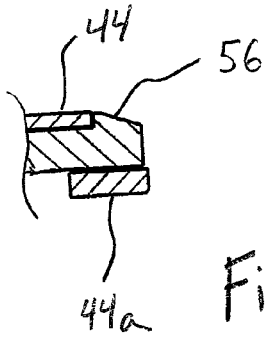
FIG. 10 is a cross-section taken along line 10-10 in FIG. 8.

FIG. 10 is a partial cross section taken along lines 10-10 in FIG. 8 and clearly illustrates how the first end locking tab 56 has a sloping surface that locks the first insulating bushing portion 44 into position adjacent the lip 44*a*.

Figure 11:
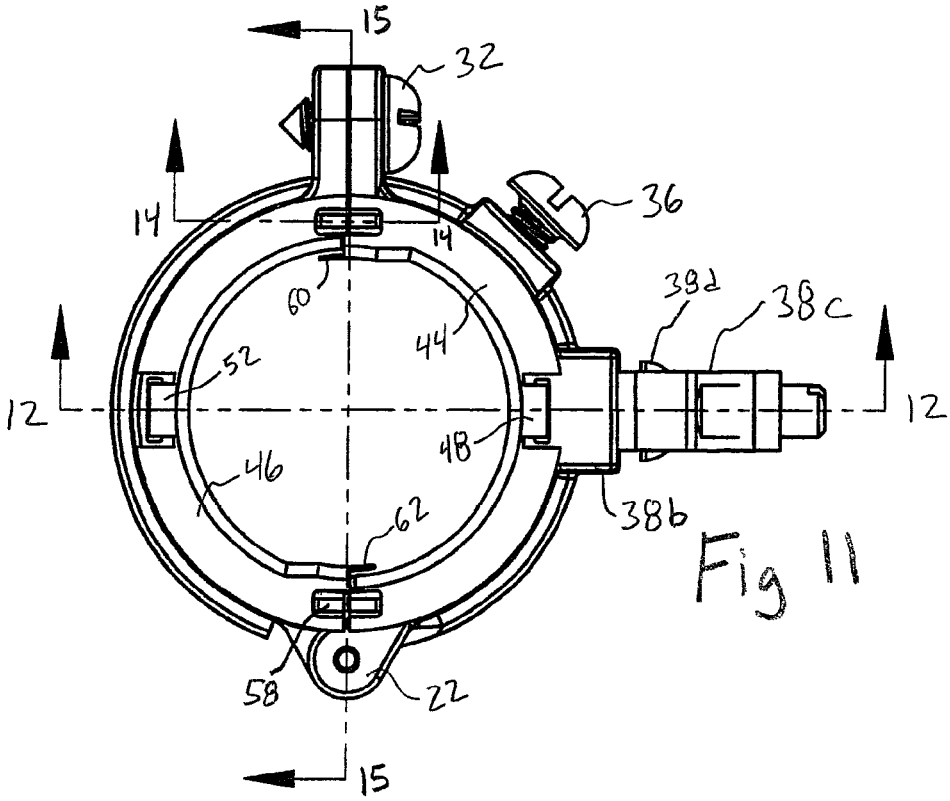
FIG. 11 is a plan view with a lug attached.
Figure 12:
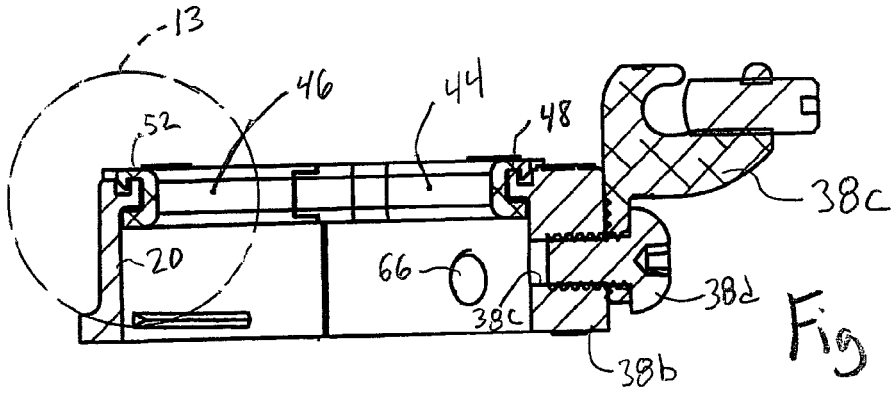
FIG. 12 is a cross section taken along line 12-12 in FIG. 11.

FIGS. 11 and 12 illustrate the split electrical grounding bushing having a different lug 38*c* attached to the lug mount 38*b* by screw 38*d*. FIG. 12 is a cross section taken along lines 12-12 in FIG. 11 and illustrates the secure attachment of the insulating bushing portions 44 and 46 with the central locking tabs 52 and 48.

Figure 13:
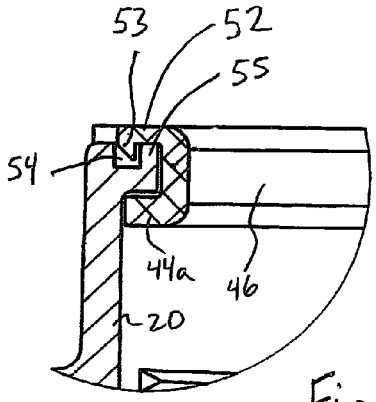
FIG. 13 is an enlarged view of dashed circle 13 illustrated in FIG. 12.

FIG. 13 is an enlarged view taken from dashed circle 13 in FIG. 12. FIG. 13 more clearly illustrates the locking tabs sloped end 53 fitting within the second locking tab opening 54. The locked sloping end 53 is securely held in position by the end wall 55 that is formed in the bushing portion 20.

Figure 14:
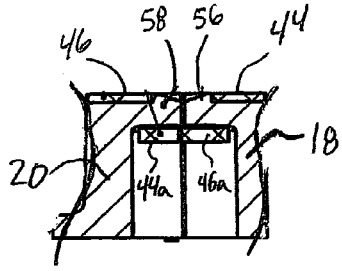
FIG. 14 is a partial cross section taken along line 14-14 in FIG. 11.

FIG. 14 is a partial cross section taken along line 14-14 in FIG. 11. In FIG. 14 the bushing portions 20 and 18 abut the end locking tabs 58 and 56 securely holding the insulating bushing portions 44 and 46 in position.

Figure 15:
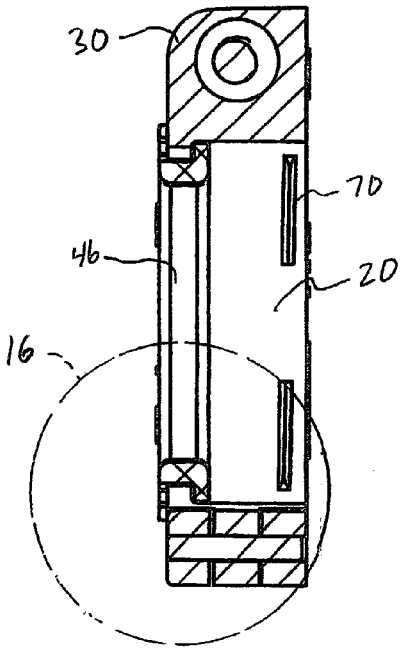
FIG. 15 is a cross section taken along line 15-15 in FIG. 11.
Figure 16:
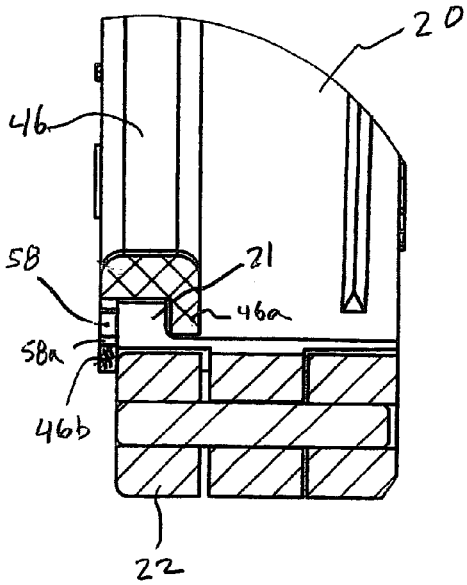
FIG. 16 is an enlarged view of dashed circle 16 illustrated in FIG. 15.

FIG. 16 is an enlarged view of the dashed circle 16 in FIG. 15. FIG. 16 clearly illustrates the end locking tab 58 placed within the locking tab opening 56*a* of the insulating bushing portion 46. The top surface 46*b* and the lip 46*a* of the second insulating bushing portion 46 is securely wrapped around rim 21 on the second bushing portion 20. This securely holds the insulating bushing portion 46 in position.

From FIGS. 6-16 it is appreciated that the insulating bushing portions 44 and 46, made of a flexible insulating material such as plastic, are easily slid over the bushing portions 18 and 20 riding on the inclined or sloped surface of the end locking tabs 56 and 58 and drop into the locking tab openings 56*a* and 58*a* when securely in position. Similarly, the central locking tabs 48 and 52 drop within locking tab openings 50 and 54 when in position securely holding the central portion of the insulating bushing portions 44 and 46.

The present invention improves the safety of a dual section or split bushing used in protecting electrical conductors or wires at the ends of electrical conduits. The present invention has the substantial advantage of forming a continuous insulation ring and yet permitting the bushing portions to be separated so as to encircle electrical conductors or wires while permitting placement on the end of an electrical conduit even after the attached or installation of the conductors or wires has been finished. The present invention also provides improved safety in eliminating potential problems that may arise due to the gap formed between the bushing portions, such as damage to the conductors or wires or creating an electrical hazard.

Additionally, the insulating bushing portions are easily placed on the bushing portions and securely locked in place by the arrangement of locking tabs and openings.

While the present invention has been described with respect to one embodiment, it will be obvious that various modifications may be made without departing from the spirit and scope of this invention.

What is claimed is:

1. A split electrical grounding bushing for placement on the end of an electrical conduit comprising:

a first bushing portion having first ends;

a second bushing portion having second ends placed adjacent the first ends of said first bushing portion, said first and second bushing portions forming a ring having gaps between the first and second ends of said first bushing portion and said second bushing portion;

a first locking tab formed adjacent each first end of said first bushing portion;

a second locking tab formed adjacent each end of said second bushing portion;

a first insulating bushing portion attached to said first bushing portion, said first insulating bushing portion having a first locking tab opening adjacent each of said first locking tabs;

a second insulating bushing portion attached to said second bushing portion, said second insulating bushing portion having a second locking tab opening adjacent each of said first locking tabs; and a guard tab extending from said first and second insulating bushing portions placed on and covering the gaps between the first and second ends of said first and second bushing portions, whereby a continuous electrical insulating ring is formed and said first and second locking tabs securely hold said first and second insulating bushing portions onto said bushing portions.

2. A bushing for placement on the end of an electrical conduit as in claim 1 wherein:

one of said guard tabs is attached to one of the first ends of said first insulating bushing portion; and another one of said guard tabs is attached to one of the first ends of said second insulating bushing portion.

3. A bushing for placement on the end of an electrical conduit as in claim 1 wherein:

said first and second locking tabs have an inclined surface.

4. A bushing for placement on the end of an electrical conduit as in claim 1 further comprising:

a first central locking tab opening formed on said first bushing portion between the first ends;

a first central locking tab formed on said first insulating bushing portion between ends thereof and adapted to fit within said first central locking tab opening;

a second central locking tab opening formed on said second bushing portion between the second ends; and a second central locking tab formed on said second insulating bushing portion between ends thereof.

5. A bushing for placement on the end of an electrical conduit as in claim 1 further comprising:

a lug having an opening formed on said first bushing portion; and a retaining screw threaded into said lug and extending into the opening, whereby a ground conductor may be secured to the bushing.

6. A bushing for placement on the end of an electrical conduit as in claim 1 further comprising:

a contact screw extending through said first bushing portion, whereby a secure electrical connection is made between the electrical conduit and the bushing and the bushing is securely held onto the electrical conduit.

7. A bushing for placement on the end of an electrical conduit as in claim 1 further comprising:

a ridge adapted to mate with a tread on the electrical conduit, whereby the bushing is securely fastened to the electrical conduit.

8. A bushing for placement on the end of an electrical conduit as in claim 1 wherein:

said first and second bushing portions are made of metal and said first and second insulating bushing portions are made of plastic.

9. A bushing for placement on the end of an electrical conduit as in claim 1 further comprising:

a hinge placed between ends of said first and second bushing portions, whereby the bushing may be opened and closed.

10. A bushing for placement on the end of an electrical conduit as in claim 9 further comprising:

means, placed on another end opposing said hinge, for securing the another end together.

11. A bushing for placement on the end of an electrical conduit as in claim 10 wherein:

said means for securing comprises a securing screw.

12. A spit electrical grounding bushing for placement on the end of an electrical conduit comprising:

a first bushing portion forming a first portion of a ring having a first and second end;

a first locking tab having an inclined surface adjacent the first end;

a second locking tab having an inclined surface adjacent the second end;

a second bushing portion forming a second portion of a ring having a third and fourth end;

a third locking tab having an inclined surface adjacent the third end;

a fourth locking tab having an inclined surface adjacent the fourth end;

a first electrical insulating bushing portion having a first locking tab opening and a second locking tab opening adjacent each end thereof, wherein said first locking tab mates with the first locking tab opening and said second locking tab mates with the second locking tab opening, whereby said first electrical insulating bushing portion is securely attached to said first bushing portion;

a second electrical insulating bushing portion having a third locking tab opening and a fourth locking tab opening adjacent each end thereof, wherein said third locking tab mates with the third locking tab opening and said fourth locking tab mates with the fourth locking tab opening, whereby said second electrical insulating bushing portion is securely attached to said second bushing portion;

a hinge attached to the second end of said first bushing portion and the fourth end of said second bushing portion;

a fastener attached to the first end of said first bushing portion and the third end of said second bushing portion, whereby the first and third ends are held together and a gap is formed between the first and third ends and the second and fourth ends;

a first guard tab portion formed on said first electrical insulating bushing portion extending over the gap formed between the first and third end;

a second guard tab portion formed on said second electrical insulating bushing portion extending over the gap formed between the second and fourth end, whereby an effective continuous ring of insulation is formed from said first and second insulating bushing portions and said first and second guard tabs covering the gaps.

13. A spit electrical grounding bushing for placement on the end of an electrical conduit as in claim 12 further comprising:

a contact screw extending through the first bushing portion, whereby a secure electrical connection is made between the electrical conduit and the bushing and the bushing is securely held onto the electrical conduit.

14. A spit electrical grounding bushing for placement on the end of an electrical conduit as in claim 12 further comprising:

a lug having an opening formed on said first bushing portion; and a retaining screw extending into the opening, whereby a ground conductor may be secured to the bushing.

15. A spit electrical grounding bushing for placement on the end of an electrical conduit as in claim 12 further comprising:

a ridge adapted to mate with a thread on the electrical conduit, whereby the bushing is securely fastened to the electrical conduit.

16. A spit ring electrical grounding bushing for placement on an end of an electrical conduit providing a continuous protective insulating ring comprising:

a first semi-circular metal bushing portion having a first inclined surface locking tab formed on each end thereof;

a second semi-circular metal bushing portion having a second inclined surface locking tab formed on each end thereof;

a first semi-circular electrical insulating bushing portion having first locking tab openings formed in each end thereof and adapted to mate with the first inclined surface locking tabs when fitted onto said first semi-circular metal bushing portion;

a second semi-circular electrical insulating bushing portion having second locking tab openings formed in each end thereof and adapted to mate with the second inclined surface locking tabs when fitted onto said first semi-circular metal bushing portion; and a guard tab extending from said first and second semi-circular electrical insulating bushing portions and covering a gap between said first semi-circular metal bushing portion and said second semi-circular metal bushing portion, whereby said first and second semi-circular electrical insulating bushing portions are securely held in position and a continuous ring of insulation is formed.

17. A spit electrical grounding bushing as in claim 16 further comprising:

a first locking tab opening formed in said first semi-circular metal bushing portion between the ends thereof;

a first locking tab formed on said first semi-circular electrical insulating bushing portion and positioned to mate with said first locking tab opening;

a second locking tab opening formed in said second semi-circular metal bushing portion between the ends thereof; and a second locking tab formed on said first semi-circular electrical insulating bushing portion and positioned to mate with said first locking tab opening.

* * * * *